US006994122B2

(12) United States Patent
Cardoen et al.

(10) Patent No.: US 6,994,122 B2
(45) **Date of Patent: *Feb. 7, 2006**

(54) HEALD FRAME FOR WEAVING MACHINE

(75) Inventors: Marnick Cardoen, Zonnebeke (BE); Geert Ostyn, Moorsledge (BE); Bart Beernaert, Boezinge (BE)

(73) Assignee: Picanol N.V., Ypres (BE)

( * ) Notice: Subject to any disclaimer, the term of this patent is extended or adjusted under 35 U.S.C. 154(b) by 0 days.

This patent is subject to a terminal disclaimer.

(21) Appl. No.: 10/915,444

(22) Filed: Aug. 11, 2004

(65) Prior Publication Data

US 2005/0022893 A1 Feb. 3, 2005

Related U.S. Application Data

(63) Continuation of application No. 10/149,426, filed as application No. PCT/EP00/09785 on Oct. 6, 2000, now Pat. No. 6,789,580.

(30) Foreign Application Priority Data

Dec. 24, 1999 (DE) ..... 199 62 977

(51) Int. Cl.
*D03C 9/06* (2006.01)

(52) U.S. Cl. ..... 139/91; 92/93; 92/94; 92/95; 92/96

(58) Field of Classification Search ..... 139/91–96
See application file for complete search history.

(56) References Cited

U.S. PATENT DOCUMENTS

| | | | | |
|---|---|---|---|---|
| 798,736 A | | 9/1905 | Lackey | |
| 2,073,936 A | | 3/1937 | Kaufmann | |
| 2,461,496 A | * | 2/1949 | Kaufmann | 139/92 |
| 2,522,043 A | * | 9/1950 | Kaufmann | 139/92 |
| 3,895,655 A | * | 7/1975 | Sujdak et al. | 139/92 |
| 4,106,530 A | * | 8/1978 | Kaufmann | 139/92 |
| 4,112,980 A | * | 9/1978 | Bader | 139/92 |
| 4,259,995 A | * | 4/1981 | Nishiyama | 139/92 |
| 6,009,918 A | * | 1/2000 | Beyaert | 139/92 |
| 6,789,580 B1 | * | 9/2004 | Cardoen et al. | 139/92 |

FOREIGN PATENT DOCUMENTS

| | | |
|---|---|---|
| JP | 10 001844 A | 1/1998 |
| JP | 11 036154 A | 2/1999 |

* cited by examiner

*Primary Examiner*—John J. Calvert
*Assistant Examiner*—Robert Muromoto
(74) *Attorney, Agent, or Firm*—Bacon & Thomas, PLLC

(57) ABSTRACT

A heald frame for a weaving machine includes stops (15, 16) made of a material with shock-absorbing properties associated with the ends of the healds (10). A gap is provided between the heald ends and the stops, such gap ensuring that the healds can be moved along guide rails forming part of the heald frame while reducing noise and potentially damaging vibrations. The healds are held on the guide rails with play and are moved by and limited in their movements in a longitudinal direction by the stops.

7 Claims, 3 Drawing Sheets

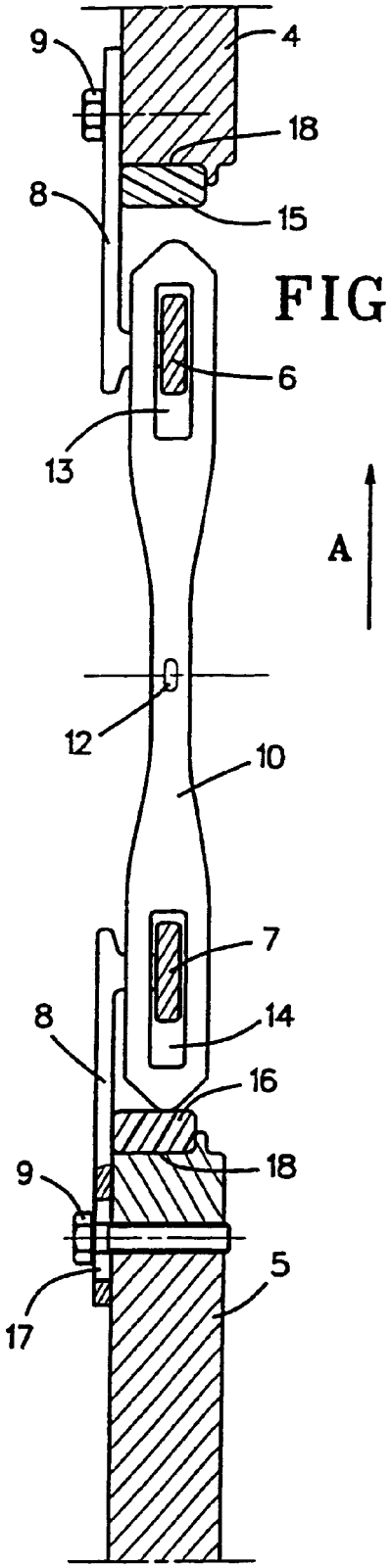
FIG. 2
FIG. 3
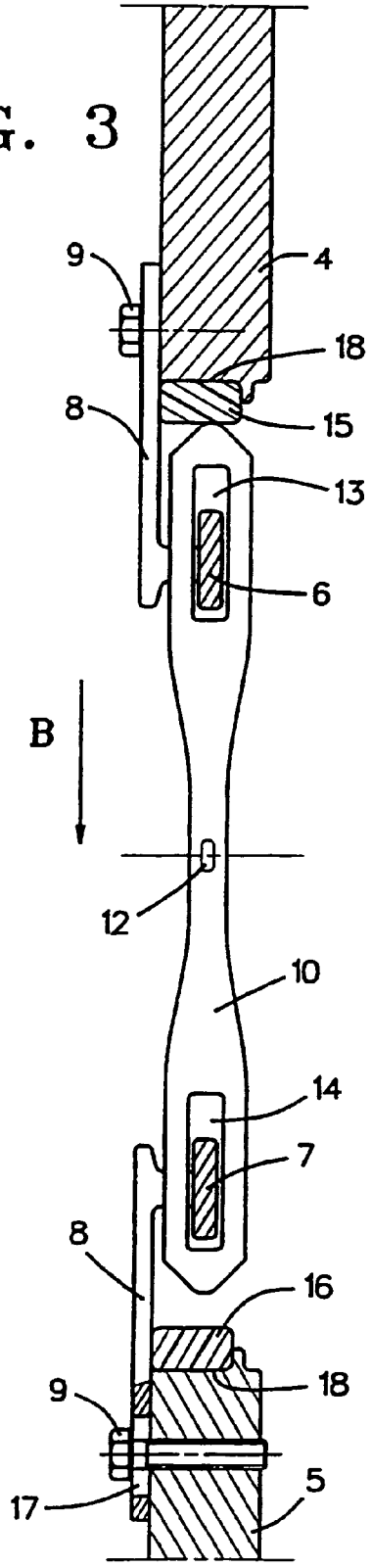

HEALD FRAME FOR WEAVING MACHINE

CROSS REFERENCE TO RELATED APPLICATION

This application is a continuation application of U.S. patent application Ser. No. 10/149,426, filed on Jun. 24, 2002.

BACKGROUND

1. Field of the Invention

The invention relates to weaving machine heald frame fitted with an upper and a lower cross-sectionally contoured rail, hereafter rail, for holding the healds which are held by guide elements located at the ends of the healds to the rails.

2. Related Art

Several heald frames of this kind constitute a so-called heald frame system. The individual heald frames of this system are alternatingly raised and lowered by a heald frame machine in order to form sheds using heald-guided warps between which fillings may be inserted. The rails and the heald guide elements typically have geometries such that, in one direction of heald frame motion, one of the rails rests by a drive surface against a cooperating surface of the heald guide elements to thereby drive such healds. In the other direction of motion, a drive surface of the other rail will drive a cooperating surface of the heald guide elements which are associated with it. Because the heald frames and the healds expand on account of heat and forces applied by the warps, and because manufacturing tolerances have to be provided for both, and because additionally the healds must be displaceable along the rails, for instance to insert or repair warps, a play of about 2–3 mm is provided for the healds between the drive surfaces of the rails and the cooperating surfaces of the guide elements. When the frames move up and down, the healds will move by said 2–3 mm relative to the rails. These motions result in impacts causing on one hand noise and on the other hand heald vibrations. At high weaving rates, these motions and particularly the thereby caused vibrations may break the healds and/or the heald frames and/or the warps.

To avoid such problems, it is known from WO 97/23396 to reduce the play between the healds and the rails by providing one or more shims fitted onto one of the rails to reduce the gap between these heald drive surfaces of this rail and the cooperating surfaces of the heald guide elements down to a slight play of about 1 mm. These shims are made of plastic, and consequently damping is attained as well. In this manner noise and the risk of damage may be reduced, although some drawbacks may be incurred regarding operability. Because the heald play is reduced longitudinally, the longitudinal movability of the healds and their movability in the direction of the rails also is restricted. As a result, an operator repairing a yarn break may be somewhat hampered and it is even possible that the healds could be bent in the course of making repairs.

BRIEF SUMMARY OF THE INVENTION

The objective of the present invention is the reduction of noise and furthermore the reduction of potential damage caused by heald vibration.

This problem is solved in that a damping stop made of material with damping properties is provided adjacent at least one end of the healds and in that the gap between this stop and the adjacent end of the healds shall be smaller than the gap between the guide element ends and the rail surfaces opposite the stop.

In this design the healds shall be driven at least in one direction by the damping stop or they shall impact the stop in one direction, as a result of which noise will be significantly reduced. Also, at least when the healds are driven in one direction or when impacted in one direction, damping shall take place and heald vibrations will be substantially reduced. This reduction in noise and adverse effect of vibrations also shall be the case for plays of larger magnitudes, for instance of 2–3 mm or more, and consequently there would be no restriction on the relative movability of the healds in the longitudinal rail direction or in their own longitudinal direction. Means are thus provided to the skilled designer to reduce the danger of noise and creaking movability or shiftability by controlling the play or to trade off somewhat more noise and somewhat greater danger of vibrations against improved heald movability.

Preferably stops shall be fitted at both heald ends. In this manner driving of the healds and the impact of the healds on drive elements takes place solely against the damping stops. The rails in accordance with this design merely provide lateral guidance. Consequently the longitudinal heald play may be selected almost arbitrarily, that is, it may be comparatively small and entail less movability and longitudinal excursion, or it may be comparatively large with commensurately good movability and longitudinal excursion.

DESCRIPTION OF THE DRAWINGS

Further features and advantages of the invention are elucidated in the description below of the illustrative embodiments shown in the attached drawings.

FIGS. 2, 3 are cross-sections along line II—II of FIG. 1 in different frame positions.

DETAILED DESCRIPTION OF THE PREFERRED EMBODIMENTS

Figure 1:
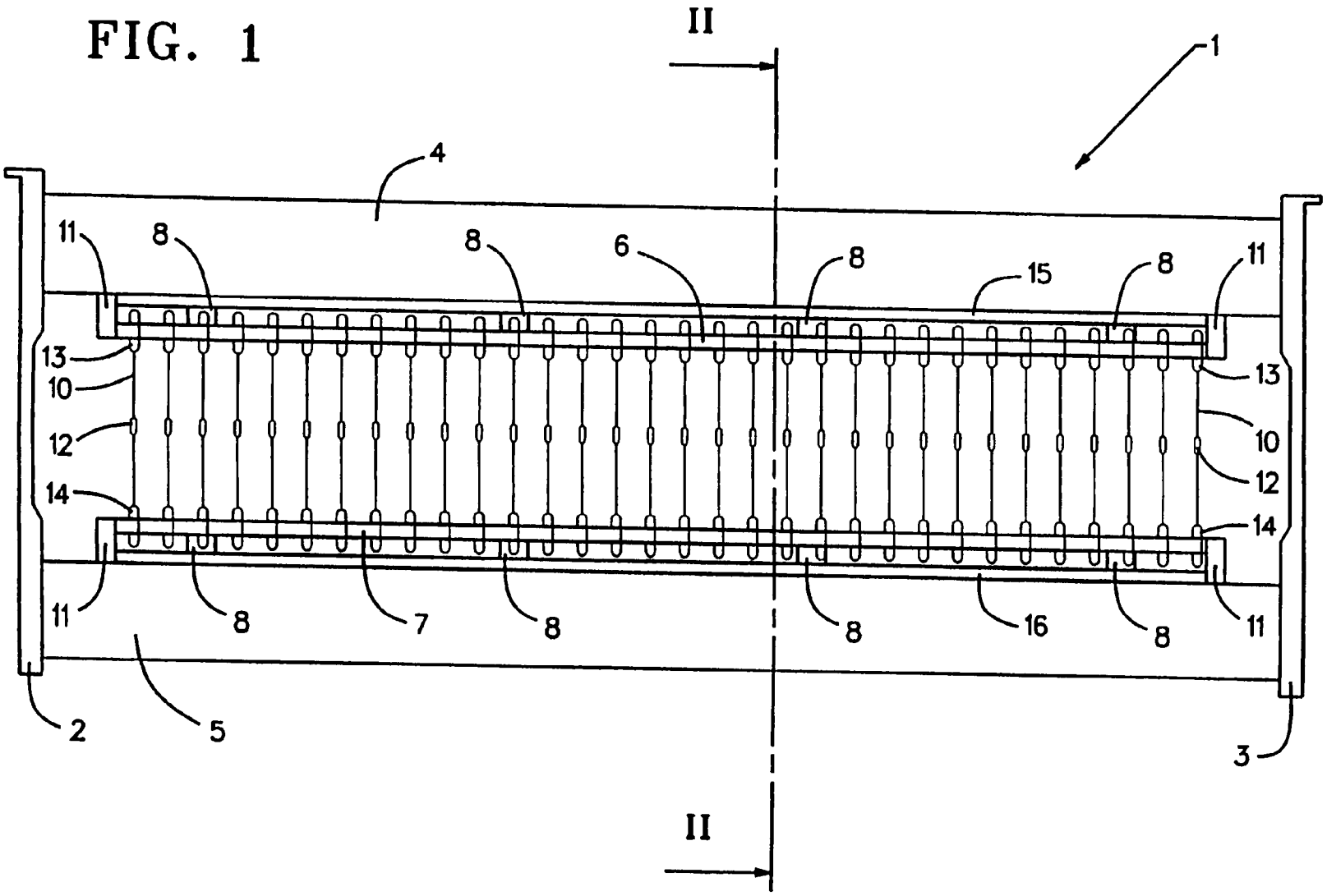
FIG. 1 is a schematic front view of a heald frame of the invention.

The heald frame 1 shown in FIG. 1 is a frame consisting of two supporting side sidebars 2 and 3 and two supporting crossbars 4, 5. Rails 6, 7 are affixed by brackets 8 in the zone of the mutually facing sides of the supporting crossbars 4, 5. These rails 6, 7 receive lamellar healds 10 each fitted centrally with a yarn eyelet 12 to receive a warp. The healds 10 are guided by guide elements 13, 14 on the rails 6, 7. The rails 6, 7 are fitted for example at their longitudinal ends with limit stops 11 to prevent the healds 10 from slipping off. The rails include opposed ends located respectively towards and away from the cross bars to which they are attached, said rail ends facing adjacent guide ends defining the limits of play between the rails and the guides, in a well known manner.

The ends of the healds 10 are associated with strip shaped heald stops 15, 16 mounted on the crossbars 4, 5 and which drive the healds 10 in the manner described below in relation to FIGS. 2 and 3. The guide elements 13, 14 of the lamellar healds 10 are dimensioned in such a way relative to the rails 6, 7 that the rails 6, 7 shall guide the healds 10 only laterally, but will not drive the healds via their ends during lifting and lowering movements. The brackets 8 of the rails 6, 7 are fastened by screws 9 to the crossbars 4, 5, said screws passing through slots 17 of the brackets 8 (FIGS. 2, 3)

running in the longitudinal direction of the healds 10. In this way the position of the rails 6, 7 is adjustable in the longitudinal direction of the lamellar healds 10 relative to the crossbars 4, 5.

When the heald frame is raised in the direction of the arrow A at the middle shed position, or when it is at its upper end position, then the lower ends of the healds 10 shall rest against the lower damping stop 16 as shown in FIG. 2. When the frame is lowered in the direction of the arrow B as indicated in FIG. 3, then the healds 10 if in the middle shed position will reverse their relative position and will come to rest by their upper end impacting against the upper damping stop 15. Because the stops 15, 16 are made of a damping synthetic material, the impulse will be decelerated and damped and on one hand the noise shall be much abated, while on the other hand the danger of damage caused by vibrations in the heald 10 is reduced. If then the frame is raised again in the direction of the arrow A as shown in FIG. 2, the healds shall on the basis of the warp tension again reverse their position in a substantially impulsive manner in the middle shed zone, and thereafter they will rest by their lower end against the lower stop 16. Accordingly the healds 10 are moved as described and their longitudinal excursions are limited solely by means of the strip shaped damping stops 15, 16 made of damping synthetic material. Therefore the play within which the healds 10 may be moved relative to the upper crossbar 4 and the lower crossbar 5 may be selected as a relatively large play without increasing the danger of more noise and/or damage. If a relatively large play is selected, it will be easier to shift the healds 10 along the longitudinal direction of the rails 6, 7 and furthermore to shift them in their own longitudinal direction with respect to the rails 6, 7—this feature being advantageous for an operator repairing a warp break.

As regards the embodiment shown in FIGS. 2 and 3, the upper crossbar 4 and the lower crossbar 5 are fitted with a seat 18 illustratively in the form of a longitudinal groove. The stops 15, 16 are strips received in this seat 18 and are affixed for instance by bonding. Such a seat 18 is recommended for new heald frames in accordance with the invention. If on the other hand already extant heald frames are being retrofitted to correspond with frames made in accordance with the invention, other means may be used to mount the strip shaped stops 15, 16. Illustratively the latter may be mounted by fasteners to the crossbars 4, 5 in such a way that they rest on the mutually opposite edges. Moreover affixing elements may be used that are affixed to but spaced from the crossbars 4, 5. In the latter case those sides of the strip shaped stops 15, 16 which are located opposite the healds 10 shall be appropriately reinforced by a reinforcing rail.

Figure 4:
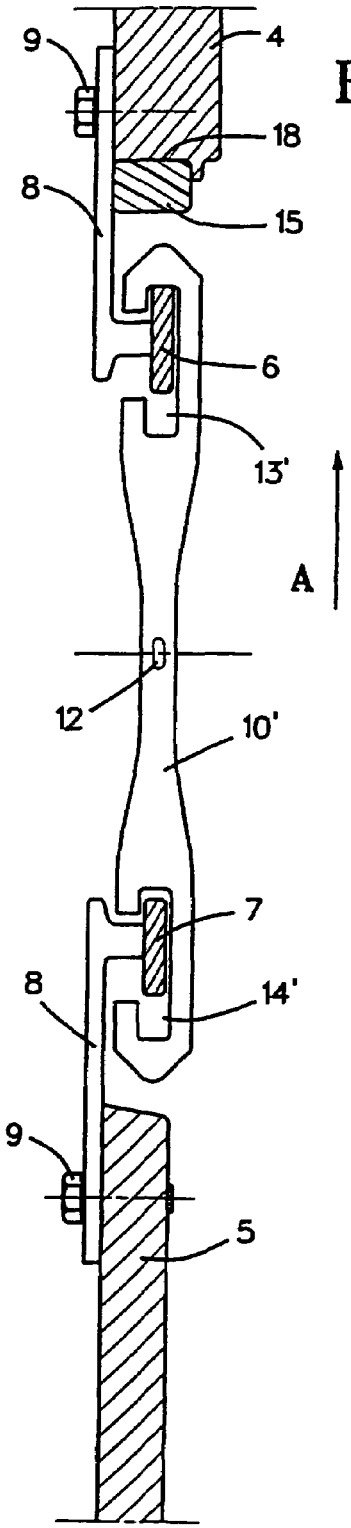
FIGS. 4, 5 are cross-sections similar to FIGS. 2, 3 of a modified embodiment with a unilateral stop
Figure 5:
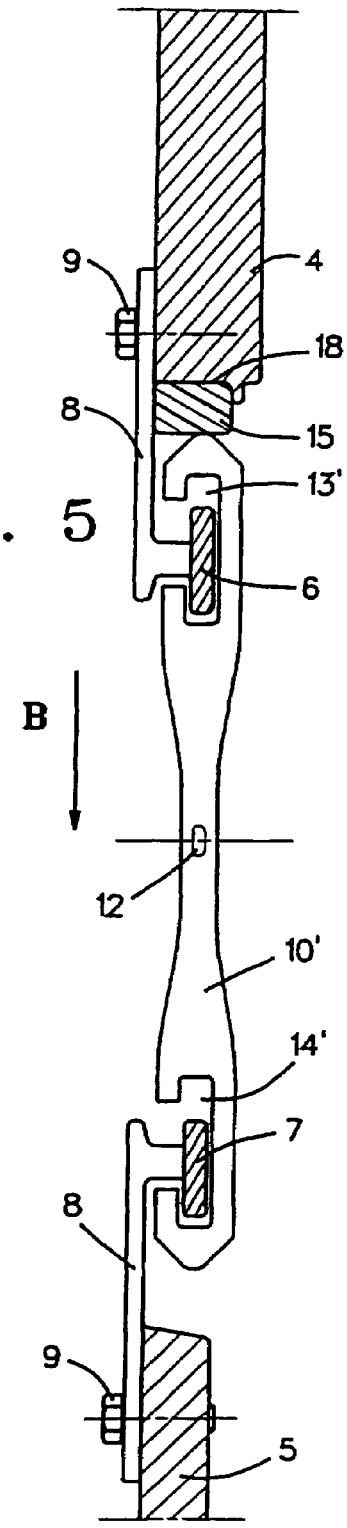

As shown in the illustrative embodiment of FIGS. 4 and 5, a substantial improvement is attained even if only one strip shaped stop 15 is used on one side, that is, as regards this embodiment, at the upper crossbar 4. In this configuration and as shown in FIG. 4, the healds 10' are raised by a drive surface of the upper rail 6, said drive surface being situated opposite a cooperating surface of the upper guide element 13'. In this embodiment, the lower rail 7 is used only to guide the heald 10' transversely. In this embodiment of FIGS. 4 and 5, the guide elements 13', 14' of the healds 10' are open toward the brackets 8 and as a result the healds 10' also may be freely displaced in the vicinity of the brackets 8. As regards another embodiment, the rail 6 and its associated guide element 13' are dimensioned in such a way that they will only be in the transverse guide mode while the healds 10' are driven in a lifting direction by the lower rail 7 which then will rest by one drive surface against a cooperating surface of the guide element 14'. Obviously one stop only may be used also in the region of the lower ends of the healds 10', for instance a stop 16 as shown in the embodiment of FIGS. 2 and 3.

What is claimed is:

1. A heald frame for a weaving machine, comprising:

an upper and a lower rail for holding healds adjacent their heald ends, said healds being held on said rails by guide elements with play;

heald stops made of material with damping properties associated with the heald ends outside said guide elements such that the healds are arranged with play between the heald stops; and wherein the healds are both moved by and limited in their movement in their longitudinal direction by means of said heald stops.

2. Heald frame as claimed in claim 1, wherein each stop is in the shape of a strip and is mounted on a respective one of an upper and lower crossbar of a framework comprising the heald frame.

3. Heald frame as claimed in claim 1, wherein at least one of the rails is adjustably mounted along a longitudinal direction of the healds on an associated crossbar comprising the heald frame.

4. Heald frame as claimed in claim 1, wherein each stop is mounted in an adjustable manner along a longitudinal direction of the healds.

5. Heald frame as claimed in claim 1, wherein each stop is made of an elastomeric synthetic material.

6. Heald frame as claimed in claim 1, wherein said play is at least 2–3 mm.

7. Heald frame as claimed 1, wherein the guide elements have guide ends and the rails have end surfaces, and when the healds are moved by and limited in their movement in their longitudinal direction by means of said heald stops, there is play between end surfaces of the rails and adjacent guide ends of said guide elements.

* * * * *